US012767900B2

(12) United States Patent
Jakubowski et al.

(10) Patent No.: US 12,767,900 B2
(45) Date of Patent: Oct. 20, 2026

(54) SYNERGISTIC PARAFFIN INHIBITORS WITH HIGH AND LOW CRYSTALLIZATION ONSET TEMPERATURES

(71) Applicant: Baker Hughes Oilfield Operations LLC, Houston, TX (US)

(72) Inventors: Wojciech Jakubowski, Sugar Land, TX (US); Rostyslav Dolog, Houston, TX (US); Radhika Suresh, Sugar Land, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 175 days.

(21) Appl. No.: 18/382,981

(22) Filed: Oct. 23, 2023

(65) Prior Publication Data

US 2025/0129299 A1 Apr. 24, 2025

(51) Int. Cl.

| | |
|---|---|
| ***C10G 29/22*** | (2006.01) |
| ***C10G 29/20*** | (2006.01) |
| ***C10G 73/04*** | (2006.01) |

(52) U.S. Cl.

CPC ..... *C10G 29/22* (2013.01); *C10G 29/20* (2013.01); *C10G 73/04* (2013.01)

(58) Field of Classification Search

CPC ..... C10G 29/22; C10G 29/20; C10L 1/1963; C10L 10/04; C10L 10/16; C08L 33/08; C08L 33/10

See application file for complete search history.

(56) References Cited

U.S. PATENT DOCUMENTS

| | | | | |
|---|---|---|---|---|
| 5,281,329 | A | 1/1994 | Mueller et al. | |
| 11,667,860 | B2 * | 6/2023 | Xu | C08L 33/08 44/403 |
| 2001/0056044 | A1 | 12/2001 | Kinker et al. | |
| 2014/0165457 | A1 * | 6/2014 | Castro | C10G 71/00 507/224 |
| 2015/0307697 | A1 * | 10/2015 | Mastrangelo | C10L 10/16 524/562 |
| 2018/0086862 | A1 | 3/2018 | Kundu et al. | |
| 2020/0017750 | A1 | 1/2020 | Mahmoudkhani et al. | |

(Continued)

FOREIGN PATENT DOCUMENTS

| | | | | |
|---|---|---|---|---|
| GB | 2082604 A * | 3/1982 | | C10L 1/1966 |
| WO | 2021228701 A1 | 11/2021 | | |

OTHER PUBLICATIONS

"International Search Report and Written Opinion for PCT/US2023/36052 mailed Feb. 28, 2024".

*Primary Examiner* — Ellen M Mcavoy

(74) *Attorney, Agent, or Firm* — Crowe & Dunlevy, P.C.

(57) ABSTRACT

In one aspect, a synergistic paraffin inhibitor includes a high-temperature intermediate and a low-temperature intermediate. The high-temperature intermediate has a high crystallization onset temperature, while the low-temperature intermediate has a low crystallization onset temperature that is within a range of about 6° C. and about 30° C. lower than the high crystallization onset temperature. In another aspect, the synergistic paraffin inhibitor is prepared by obtaining a high-temperature intermediate and a low-temperature intermediate. The high-temperature intermediate and the low-temperature intermediate are mixed to form the synergistic paraffin inhibitor, which may be introduced to a crude oil.

20 Claims, 4 Drawing Sheets

(56) References Cited

U.S. PATENT DOCUMENTS

| | | | | |
|---|---|---|---|---|
| 2022/0380590 | A1* | 12/2022 | Feustel | C10L 10/16 |
| 2022/0403271 | A1 | 12/2022 | Xu et al. | |
| 2025/0034446 | A1* | 1/2025 | Kumar | C10L 10/14 |

* cited by examiner

SYNERGISTIC PARAFFIN INHIBITORS WITH HIGH AND LOW CRYSTALLIZATION ONSET TEMPERATURES

FIELD OF THE INVENTION

This disclosure generally relates to hydrocarbon production and, more particularly, but not by way of limitation, to synergistic paraffin inhibitors and methods for reducing wax crystal formation and deposition.

BACKGROUND OF THE INVENTION

Paraffin hydrocarbons (also known as alkanes) are high molecular weight compounds with a formula of $C_{(n)}H_{(2n+2)}$ that are commonly found in crude oil. Paraffins for which n is greater than or equal to 18 often form wax-like deposits on production components in response to temperature and pressure changes. The pour point of a crude oil is the temperature below which a crude oil ceases to pour because of the formation of excessive paraffin content due to wax precipitation. As wax precipitation continues, the crude oil eventually gels and loses fluidity at the gel point. If an effective paraffin management strategy is not implemented, the accumulation of paraffin deposits ("wax") can significantly restrict flow in equipment, which may result in costly lost production, increased power requirements, shut-ins, and equipment repairs.

To boost production and lower operating costs in crude oils with a high wax content, paraffin inhibitors are often introduced to inhibit wax crystal formation and reduce deposition that would otherwise impede flow. These paraffin inhibitors are waxy polymers that are designed to interact in various ways with the paraffin/wax in the crude. For example, a paraffin inhibitor may be used as a paraffin deposition inhibitor, a pour-point depressant, and/or a paraffin dispersant. Paraffin deposition inhibitors prevent surface adhesion by inhibiting the initial formation of wax crystals or by modifying the wax's shape and size. Pour-point depressants, on the other hand, are used to lower a crude oil's pour point and fluid viscosity, thereby preventing the formation of wax crystals at temperatures that would otherwise be too cold for oil flow. Paraffin dispersants prevent paraffin deposition by repelling paraffin particles from each other and from equipment surfaces. In some instances, the same paraffin inhibitor formulation may be used for one or more of these purposes.

The composition of a particular crude oil significantly influences the performance of paraffin inhibitors. To optimize performance, paraffin inhibitors for a particular oil are designed to lose solubility at approximately the same rate and temperature range as the paraffin(s) within the oil. Because paraffins typically begin crystallization at high temperatures, polymers with similarly high crystallization onset temperatures, and typically with long alkyl chain groups (e.g., C18 and above), are often used in the paraffin inhibitor. Current paraffin inhibitors are formulated with one or more polymers, each with a high crystallization onset temperature. Polymers with a low crystallization onset temperature (e.g., having an average alkyl chain length below C18) are not common in current paraffin inhibitors due to their poor performance in addressing paraffins with high crystallization onset temperatures.

Despite the relative success of traditional paraffin inhibitors, polymers with high crystallization onset temperatures are reaching performance limits for many modern applications. Certain oilfields have very high wax content, and current paraffin inhibitors are not efficient enough to warrant economical exploration of those fields. Although increasing the dosage of a paraffin inhibitor sometimes helps to boost performance, this option increases the cost of the treatment and may therefore be cost prohibitive.

A need exists, therefore, for a more efficient and less expensive paraffin inhibitor to effectively address wax crystal formation and deposition. Further, a need exists for a paraffin inhibitor capable of addressing crude oils with very high wax contents. The present disclosure is directed at these and other deficiencies in the prior art.

SUMMARY OF THE INVENTION

In one aspect, the present disclosure is directed to a synergistic paraffin inhibitor that includes a high-temperature intermediate and a low-temperature intermediate. The high-temperature intermediate has a high crystallization onset temperature, while the low-temperature intermediate has a low crystallization onset temperature that is within a range of about 6° C. and about 30° C. lower than the high crystallization onset temperature.

In another aspect, a method of preparing a synergistic paraffin inhibitor is disclosed. The method includes the steps of obtaining a high-temperature intermediate with a high crystallization onset temperature and obtaining a low-temperature intermediate with a low crystallization onset temperature, which is within a range of about 6° C. and about 30° C. lower than the high crystallization onset temperature. The high-temperature intermediate and the low-temperature intermediate are mixed to form the synergistic paraffin inhibitor.

In yet another aspect, the disclosure is directed to a method of treating a crude oil with the synergistic paraffin inhibitor. The method involves preparing the synergistic paraffin inhibitor and introducing the synergistic paraffin inhibitor to the crude oil. The step of preparing the synergistic paraffin inhibitor includes the steps of obtaining a high-temperature intermediate with a high crystallization onset temperature, obtaining a low-temperature intermediate with a low crystallization onset temperature, and mixing the high-temperature intermediate and the low-temperature intermediate. The low crystallization onset temperature is within a range of about 6° C. and about 30° C. lower than the high crystallization onset temperature.

DETAILED DESCRIPTION

Figure 1:
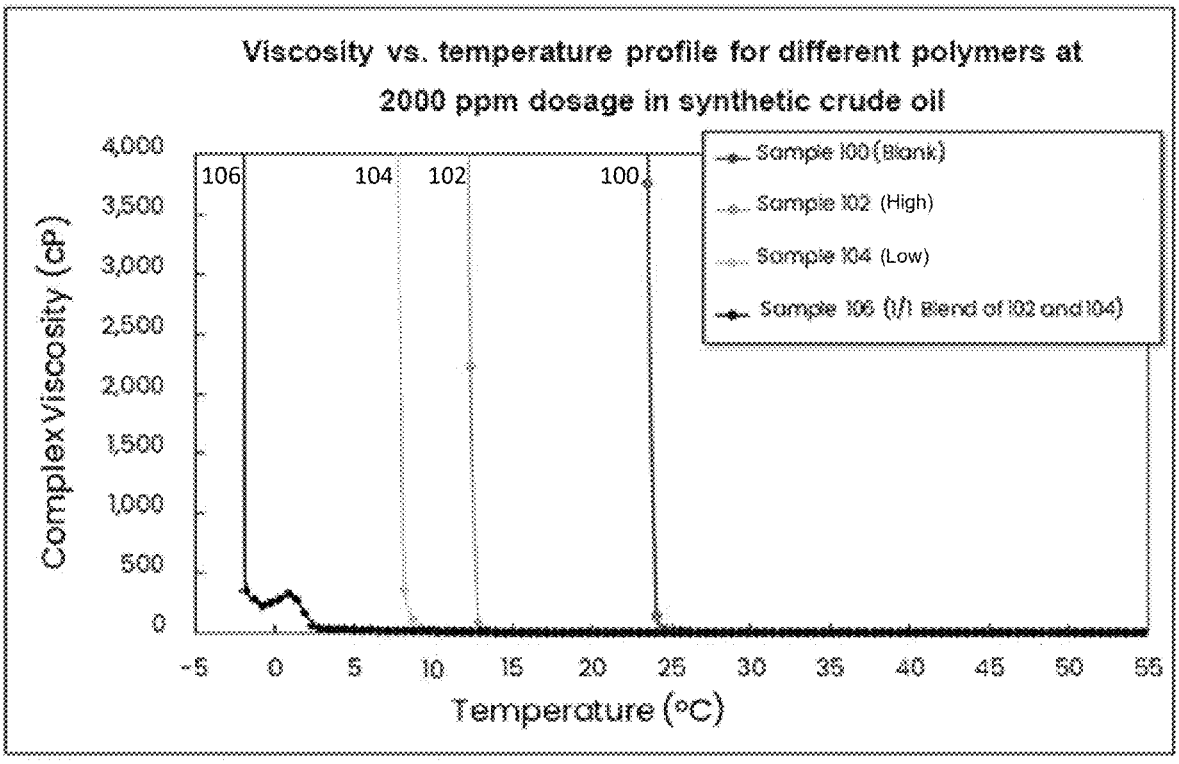
FIG. 1 graphically illustrates the viscosity versus temperature profiles of polymers with high and low crystallization onset temperatures, alone and in combination in accordance with an exemplary embodiment.

Under industry standard practices, polymers that begin crystallization at a high temperature are regularly introduced into high-molecular-weight waxes to prevent wax deposition and oil crude gelling. Polymers that begin crystallization at relatively lower temperatures, on the other hand, often demonstrate poor performance when introduced to these high-molecular-weight waxes. Traditional paraffin inhibitor formulations have therefore relied on polymers that begin crystallization at a relatively high temperature, while avoiding the use of polymers that begin crystallization at lower temperatures.

Surprisingly, it has been discovered that the combination of polymers with different crystallization onset temperatures produces a synergistic effect in paraffin inhibitors. Specifically, combining polymers that begin crystallization at high temperatures with polymers that begin crystallization at low temperatures has the unexpected result of creating a paraffin inhibitor that is more effective in a crude oil than a paraffin inhibitor based solely on high-crystallization-temperature polymers at the same dosage. The components of this new paraffin inhibitor interact with different waxes distributed in the crude oil and permit flow at lower temperatures than current paraffin inhibitor products. The incorporation of polymers with a low crystallization onset temperature also lowers the overall price of the paraffin inhibitor, as these polymers (which typically have shorter alkyl chains) are less expensive than polymers with long alkyl chains that crystallize at high temperatures.

In one aspect, a synergistic paraffin inhibitor includes a high-temperature intermediate and a low-temperature intermediate. By "paraffin inhibitor" it is meant a formulation that is suitable for use as at least one of a paraffin deposition inhibitor, a pour-point depressant, and a paraffin dispersant. The term "intermediate" refers to a component that can be mixed or otherwise combined with another component to form an end product, such as a paraffin inhibitor.

Preparation of the synergistic paraffin inhibitor involves selecting a suitable high-temperature intermediate. It will be appreciated that the optimal high-temperature intermediate will depend on the type of oil to be treated. For example, selection of the high-temperature intermediate may depend on factors such as crude oil composition and which paraffin (s) and/or wax(es) are targeted by the synergistic paraffin inhibitor. After the high-temperature intermediate is identified for use in the synergistic paraffin inhibitor, the low-temperature intermediate is selected to produce a synergistic effect with the high-temperature intermediate, based on a difference in crystallization onset temperatures for the intermediates.

The crystallization onset temperature of the high-temperature intermediate is herein termed a high crystallization onset temperature, while the low-temperature intermediate is termed a low crystallization onset temperature. "Crystallization onset temperature," as referred to herein, is defined as the temperature of crystallization onset for a sample of 1 wt. % polymer(s) in a 4:1 wt./wt. mixture of decane/xylene measured by differential scanning calorimetry, where the sample is cooled from 120° C. to −50° C. at 10° C./min. This measurement of crystallization onset temperature is termed the Petrolite™ Crystallization Index (PCI). Whether the crystallization onset temperature is "high" or "low" is relative, based on the respective selection of the high-temperature intermediate and the low-temperature intermediate.

The high crystallization onset temperature may vary significantly based on the type of high-temperature intermediate used in the synergistic paraffin inhibitor. In various non-limiting embodiments, the high crystallization onset temperature is within a range of from about 5° C. to about 23° C. In other non-limiting embodiments, the high crystallization onset temperature is in a range between about 5° C. and about 18° C. While these temperatures suitably characterize the high-temperature intermediates used to treat certain crude oils, it will be appreciated that the optimal high-temperature intermediates for treating other oils may have high crystallization onset temperatures that are higher or lower than the above-recited ranges. For example, the high crystallization onset temperature for the high-temperature intermediate in one non-limiting embodiment is about 2° C., while the high crystallization onset temperature in another non-limiting embodiment is about 25° C.

The low crystallization onset temperature is defined relative to the high crystallization onset temperature. In certain embodiments, the difference in the high crystallization onset temperature and the low crystallization onset temperature is between about 6° C. and about 30° C. For example, in some embodiments, the low crystallization onset temperature is within a range from about 6° C. to about 30° C. lower than the high crystallization onset temperature.

The high-temperature intermediate includes one or more polymers and will generally include at least one polymer having a long alkyl chain. Suitable polymers include polyacrylates, polyacrylate and polymethacrylate copolymers, olefin maleic esters, olefin maleic imides and phenolic resins. In a non-limiting example, suitable high-temperature intermediates include polyacrylates with an average alkyl chain length between C17 and C22 (i.e., an alkyl chain having between 17 carbons and 22 carbons). Other suitable high-temperature intermediates can be formulated from olefin maleic esters synthesized from C20 to C30+ olefin and C18 to C30+ alcohol with half ester groups, olefin maleic imides synthesized from C20 to C30+ olefin and C18 to C30+ amine, and phenolic resins with average alkyl chain length higher than C28. In one non-limiting embodiment, the high-temperature intermediate includes at least one of the following: polymers of behenyl acrylate, hexadecyl acrylate, and stearyl acrylate, and copolymers of the same acylates.

The low-temperature intermediate also includes one or more polymers, and generally these polymers will have a shorter alkyl chain. Suitable polymers include polyacrylates, polymethacrylates, polyacrylate and polymethacrylate copolymers, olefin maleic esters, olefin maleic imides, and phenolic resins. In a non-limiting example, suitable low-temperature intermediates include polyacrylates with an average alkyl chain length between C12 and C16. Other suitable low-temperature intermediates can be formulated from olefin maleic esters synthesized from C20 to C28 olefin and C12 to C18 alcohol with half ester groups, olefin maleic imides synthesized from C20 to C28 olefin and tallow amine, and phenolic resins with average alkyl chain length between C16 and C28. In several non-limiting embodiments, suitable polymers for the low-temperature intermediate are polymers of behenyl methacrylate, stearyl methacrylate, and copolymers of the same methacrylates.

As noted above, in general, the high-temperature intermediate may include polymers with a longer alkyl chain length, and the low-temperature intermediate may include polymers with a shorter alkyl chain length. A linear relationship between alkyl chain length and measured PCI values has been observed for polymers with the same comonomers. The high-temperature intermediate may also have a relatively higher molecular weight, while the low-temperature intermediate may have a relatively lower molecular weight. It has been observed that polymers with a low molecular weight tend to have a higher PCI value, but this is not always the case. Although these trends have been observed, and these factors may have a small impact on a polymer's PCI value, it will be appreciated that neither the polymer's length of alkyl chain(s) nor its molecular weight is determinative of its PCI value. Indeed, in various non-limiting embodiments, the low-temperature intermediate includes a polymer with a longer alkyl chain length and/or a relatively higher molecular weight, and the high-temperature intermediate includes a polymer with a shorter chain length and/or a relatively lower molecular weight.

In one embodiment of the synergistic paraffin inhibitor, the high-temperature intermediate includes a copolymer of stearyl acrylate and hexadecyl acrylate, and the low-temperature intermediate includes a copolymer of behenyl methacrylate and stearyl methacrylate, where the high-temperature intermediate and the low-temperature intermediate have a difference in crystallization onset temperature between about 13° C. and about 14° C.

In another embodiment, the high-temperature intermediate of the synergistic paraffin inhibitor includes poly(stearyl acrylate), and the low-temperature intermediate includes a poly(stearyl methacrylate). The difference in crystallization onset temperature for said embodiment is between about 22° C. and about 23° C.

In another embodiment, the high-temperature intermediate includes poly(behenyl acrylate) and a copolymer of stearyl acrylate and behenyl acrylate. The low-temperature intermediate of the synergistic paraffin inhibitor includes a copolymer of behenyl methacrylate and stearyl methacrylate.

The synergistic paraffin inhibitor in another embodiment includes a high-temperature intermediate with a copolymer of stearyl acrylate and behenyl acrylate, and a low-temperature intermediate that includes a copolymer of behenyl methacrylate and stearyl methacrylate, where the difference between the high crystallization onset temperature and the low crystallization onset temperature is about 21° C.

In yet another embodiment, the high-temperature intermediate of the synergistic paraffin inhibitor includes a copolymer of stearyl acrylate and behenyl acrylate. The low-temperature intermediate of said embodiment includes an olefin maleic imide polymer having a low crystallization onset temperature that is between about 18° C. and about 19° C. below the high crystallization onset temperature.

In yet another embodiment, the high-temperature intermediate includes a polymer of stearyl acrylate, and the low-temperature intermediate includes a phenolic resin polymer with an average alkyl chain length between C20 and C28. The difference between the high and low crystallization onset temperatures is between about 6° C. and about 7° C.

The optimal ratio between the high-temperature intermediate and the low-temperature intermediate in the synergistic paraffin inhibitor is influenced by factors including the type of crude oil, the target paraffin, and temperature. The high-temperature intermediate and the low-temperature intermediate of various embodiments are present in a ratio within a range of about 1:20 and about 20:1 (high-temperature intermediate:low-temperature intermediate). In various non-limiting embodiments, the high-temperature intermediate and the low-temperature intermediate are present in a ratio within a range between about 1:4 and about 4:1, between about 1:3 and about 3:1, or between about 1:2 and about 2:1. The synergistic paraffin inhibitor of one embodiment includes a ratio of about 1:1 high-temperature intermediate to low-temperature intermediate.

In another aspect, a method of treating a system with a synergistic paraffin inhibitor is disclosed where the method includes the steps of preparing the synergistic paraffin inhibitor and introducing the synergistic paraffin inhibitor to the system. Depending on the intended use for the synergistic paraffin inhibitor, suitable systems for treatment include surfaces and fluids. The synergistic paraffin inhibitor may be applied as a paraffin deposition inhibitor, a pour-point depressant, and a paraffin dispersant in various embodiments. Where the focal challenge is preventing paraffin deposition on an equipment surface (e.g., the sides of a pipe), the synergistic paraffin inhibitor is applied as the paraffin deposition inhibitor or as the paraffin dispersant, and mitigation efforts target surfaces of the relevant equipment as the treated system. Where, instead, the primary concern is preventing crude gelation in bulk within equipment (e.g., within a pipe), the synergistic paraffin inhibitor is applied as the pour-point depressant, and treatment efforts target the fluid as the system of interest.

Preparation of the synergistic paraffin inhibitor involves obtaining a suitable high-temperature intermediate with a high crystallization onset temperature and obtaining a low-temperature intermediate with a low crystallization onset temperature relative to the high crystallization onset temperature. The low crystallization onset temperature is within a range of between about 6° C. and about 30° C. lower than the high crystallization onset temperature. The high-temperature intermediate is mixed with the low-temperature intermediate to obtain the synergistic paraffin inhibitor. In some embodiments, the method of preparing the synergistic paraffin inhibitor will also involve identifying the high-temperature intermediate as suitable for treating a specific oil, such as a synthetic oil, a crude oil, or heavy crude oil. This determination step may involve evaluating the composition of the specific oil, e.g., what paraffin(s) and/or wax(es) are present.

In one embodiment, the step of obtaining the high-temperature intermediate involves polymerizing behenyl acrylate, hexadecyl acrylate, stearyl acrylate, or a combination of the same acrylates. In another embodiment, obtaining the low-temperature intermediate further involves the step of polymerizing behenyl methacrylate, stearyl methacrylate, a combination of behenyl methacrylate and stearyl methacrylate, olefin maleic imides or olefin maleic esters.

Where the system is a fluid, it will be appreciated that the synergistic paraffin inhibitor may be introduced to the system by being injected at a single injection point or at multiple injection points. Where the system is a surface (e.g., an equipment surface in contact with crude oil), the synergistic paraffin inhibitor may also be injected at either a single injection point or at multiple injection points. Additional doses of the synergistic paraffin inhibitor may be introduced periodically or as needed to prevent wax crystallization and deposition in the system.

In certain embodiments, the method involves an additional evaluation stage, where the crude oil is evaluated to characterize its paraffin and/or wax content before preparation of the synergistic paraffin inhibitor. Where applicable, the target paraffin may be identified during this evaluation stage.

Example I

In an initial evaluation period, the PCI value for various polymers was determined, and these polymers were arranged in order of their crystallization onset temperatures.

Polymers that demonstrated strong performance in treating an oil were identified as suitable high-temperature intermediates for said oil. Each of the identified high-temperature intermediates was tested in combination with polymers having a lower PCI to determine which combinations created a synergistic effect. For all synergistic combinations, the difference in PCI for the high-temperature intermediates and the low-temperature intermediates was noted.

Example II

Various tests were performed to measure the performance of various polymers with high and low crystallization onset temperatures, alone and in combination, as pour point depressants. The samples of Table 1 were obtained were obtained for these tests.

TABLE 1

| Sample No. | Description | Polymers |
|---|---|---|
| 100 | Blank | N/A |
| 102 | PCI = 6.4° C. (high) active | Copolymer of stearyl acrylate and hexadecyl acrylate (4:1 wt./wt. ratio) |
| 104 | PCI = −6.9° C. (low) | Copolymer of behenyl methacrylate and stearyl methacrylate with approximately 1:1 wt./wt. ratio |
| 106 | Blend of PCI = 6.4° C. (high) and PCI = −6.9° C. (low) | Mixture of the Sample 102 copolymer and the Sample 104 polymer in approximately 1:1 wt./wt. ratio |

Test bottles were prepared with a synthetic crude oil that had a 20 wt. % wax concentration, and each bottle was treated with one of Samples 100, 102, 104, and 106, each sample with 30 wt. % of polymer and 70 wt. % of solvent. These bottles were subjected to a mini bottle pour point test and subsequently underwent a rheometer test at 2,000 ppm to determine the respective viscosity profiles at various temperatures, as depicted at FIG. 1. The results for these two tests are shown in Table 2.

TABLE 2

| Sample No. | Pour Point (° C.) from mini bottle pour point test | Gel Point (° C.) from rheometer test at 500 cP |
|---|---|---|
| 100 | 27 | 24.0 |
| 102 | 9 | 12.8 |
| 104 | 6 | 8.1 |
| 106 | <6 | −1.9(1.8)* |

*Value at 150 cP instead of 500 cP

As demonstrated by these results, the addition of Samples 102, 104, and 106 to the synthetic oil decreased the pour point and gel point in varying degrees compared to the blank. The best performance was observed from the blend of the high-temperature intermediate and the low-temperature intermediate (Sample 106).

Example III

Figure 2:
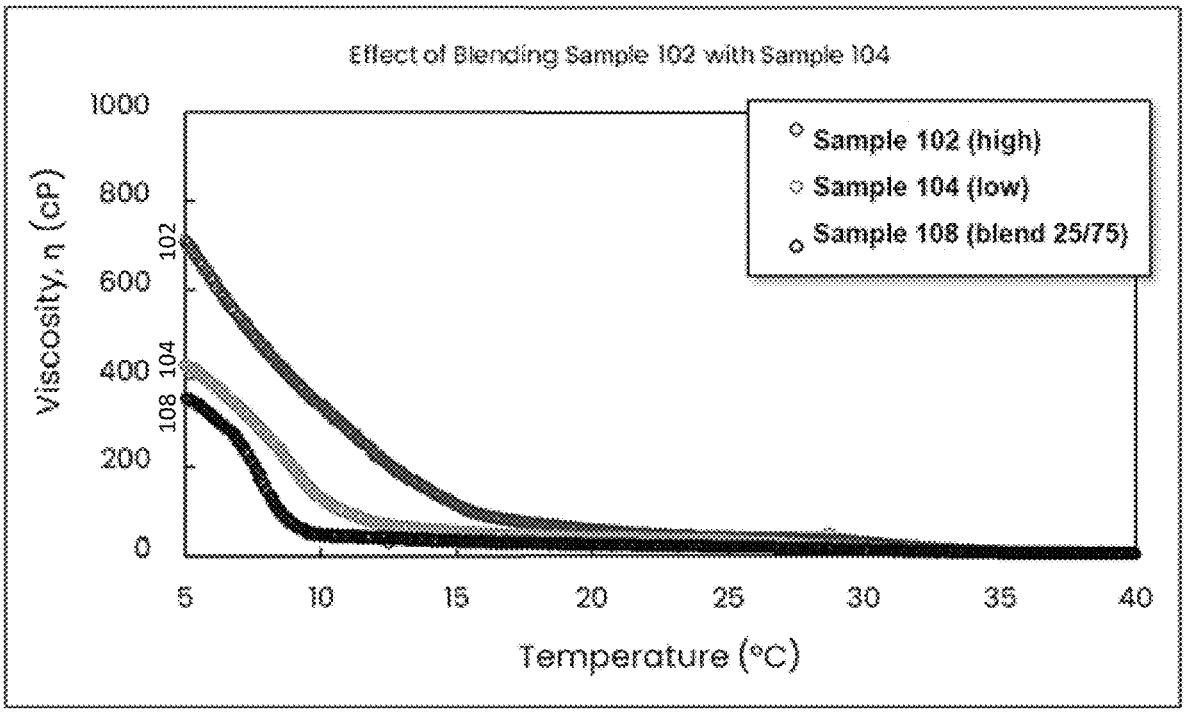
FIG. 2 graphically illustrates the viscosity versus temperature profiles of polymers with high and low crystallization onset temperatures, alone and in combination in accordance with another exemplary embodiment.

Additional tests were performed to further evaluate the intermediates of Samples 102 and 104 from Example II when blended in a different ratio and applied to a different oil as pour point depressants. Samples 102 and 104 were blended in a 25 wt. % to 75 wt. % ratio (Sample 102/Sample 104) to obtain Sample 108. A crude oil from Nigeria was then treated with the same dosage of Samples 102, 104, and 108. The viscosity of these treated crudes was then evaluated at different temperatures, with the results depicted in FIG. 2.

For this crude oil, Sample 104 (having a low crystallization onset temperature polymer) decreased the viscosity of the crude more than Sample 102 (having a high crystallization polymer). The best performing treatment was the blend of Sample 108, which demonstrated a synergistic effect between the high and low crystallization polymers in decreasing the viscosity of the crude.

Example IV

Figure 3:
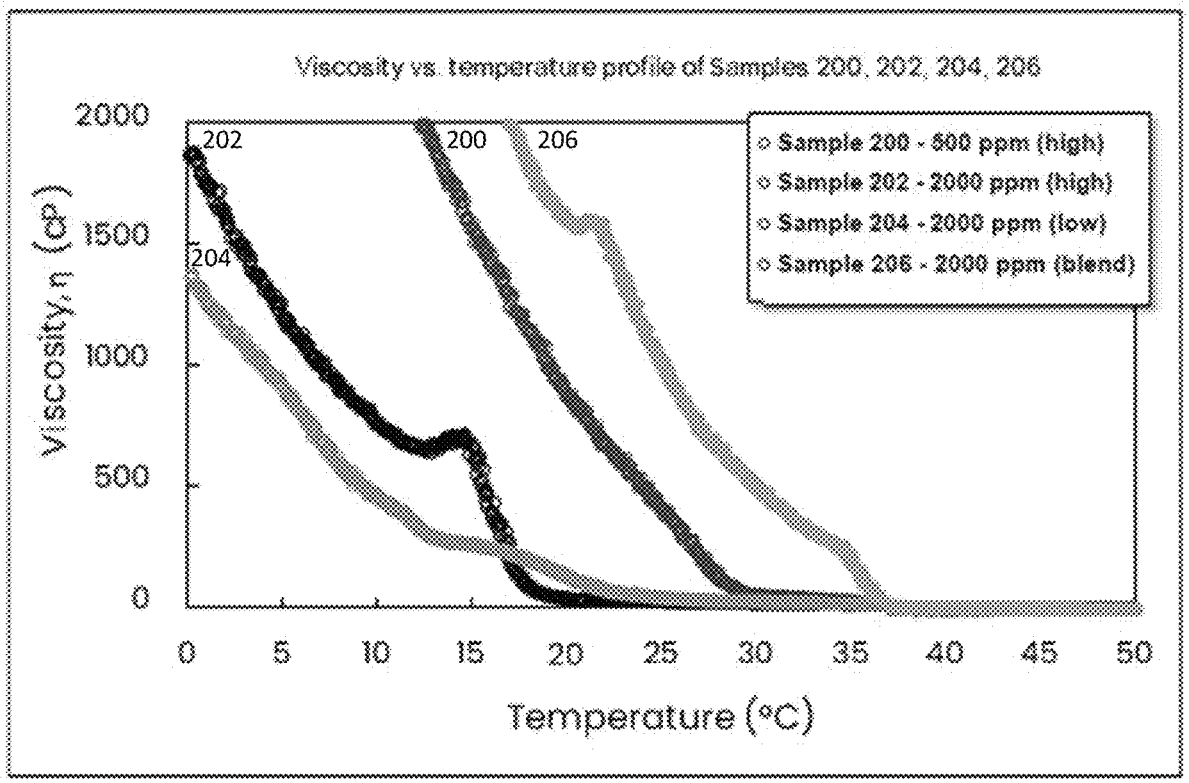
FIG. 3 graphically illustrates the viscosity versus temperature profiles of polymers with high and low crystallization onset temperatures, alone and in combination in accordance with another exemplary embodiment.

For this test, the effect of blending polymers with high and low crystallization onset temperatures was further observed. The samples of Table 3 were prepared and added to the Nigerian crude oil of Example III in various amounts as pour point depressants. The viscosity results for these samples at different temperatures are depicted in FIG. 3.

TABLE 3

| Sample No. | Description | Polymers | Polymer Amount in Crude Oil |
|---|---|---|---|
| 200 | PCI = 8.3° C. (high) | Polymer of stearyl acrylate | 500 ppm |
| 202 | PCI = 8.3° C. (high) | Polymer of stearyl acrylate | 2,000 ppm |
| 204 | Blend of PCI = 8.3° C. (high) and PCI = −14.6° C. (low) | Mixture of the Sample 200/202 polymer and the Sample 206 polymer in approximately 25:75 wt./wt. ratio | 2,000 ppm |
| 206 | PCI = −14.6° C. (low) | Polymer of stearyl methacrylate | 2,000 ppm |

These samples produced less of a decrease in the crude oil's viscosity compared with the samples of Example III. Nevertheless, the blend of high and low PCI polymers in Sample 204 resulted in the greatest decrease in viscosity of any of the Samples.

Example V

The performance for another blend of polymers with different crystallization onset temperatures was compared with the performance of various high-crystallization-temperature polymers formulated in the absence of a low-crystallization-temperature polymer. A crude oil from Vietnam was treated with 4,000 ppm of each of the samples in Table 4.

TABLE 4

| Sample No. | Description | Polymers |
|---|---|---|
| 300 | Blank | — |
| 302 | PCI = 9.5° C. (high) | Copolymer of stearyl acrylate and behenyl acrylate (4:1 wt./wt.) |
| 304 | PCI = 20.1° C. (high) | Copolymer of stearyl acrylate and behenyl acrylate (1:4 wt./wt.) |
| 306 | Blend of PCI = 22.9° C. (high), PCI = 14.1° C. (high), and PCI = −9.3° C. (low) in approximately 1:7:2 wt./wt./wt. ratio | 22.9° C. = polymer of behenyl acrylate<br>14.1° C. = copolymer of stearyl acrylate and behenyl acrylate (1:1 wt./wt.)<br>−9.3° C. = copolymer of behenyl methacrylate and stearyl methacrylate (2:1 wt./wt.) where behenyl methacrylate monomer is based on a mixture of behenyl methacrylate and stearyl methacrylate with approximately 1:1 wt./wt. ratio |

Figure 4:
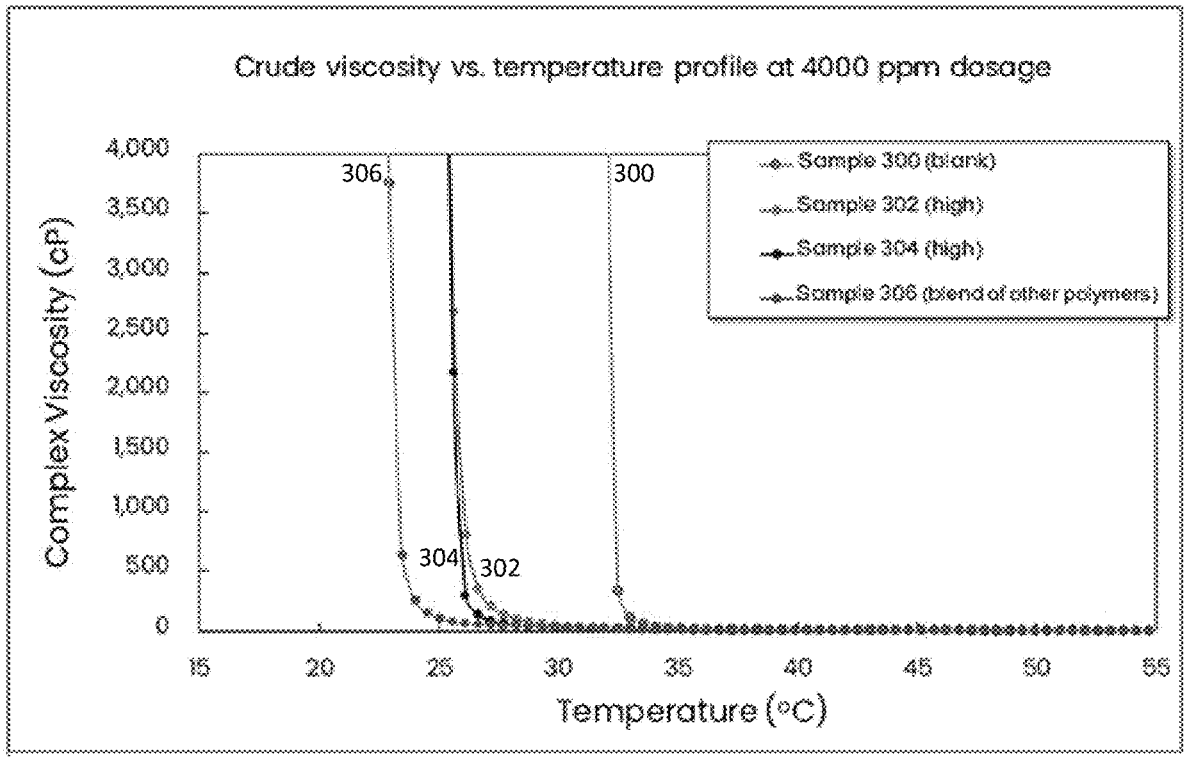
FIG. 4 graphically illustrates the viscosity versus temperature profiles of polymers with high and low crystallization onset temperatures, alone and in combination in accordance with another exemplary embodiment.

As shown in FIG. 4, the high-crystallization-temperature polymers of Samples 302 and 304 provided some reduction in crude oil viscosity compared to the blank. However, Sample 306 decreased the viscosity noticeably further than either Sample 302 or 304. These results demonstrate that the synergistic combination of polymers with high and low crystallization onset temperatures may be more effective at treating high wax crude oils than traditional paraffin inhibitor formulations that have relied solely on high-crystallization-temperature polymers.

Example V

Yet another round of tests was performed with samples introduced to a Malaysian crude oil as pour point depressants. The samples for these tests, as well as the amounts introduced in the crude, are listed in Table 5.

TABLE 5

| Sample No. | Description | Polymers | Polymer Amount in Crude Oil |
|---|---|---|---|
| 400 | Blank | N/A | N/A |
| 402 | PCI = 14.1° C. (high) | Copolymer of stearyl acrylate and behenyl acrylate (1:1 wt./wt.) | 1,500 ppm |
| 404 | PCI = 14.1° C. (high) | Copolymer of stearyl acrylate and behenyl acrylate (1:1 wt./wt.) | 3,000 ppm |
| 406 | PCI = −6.9° C. (low) | The Sample 104 copolymer of behenyl methacrylate and stearyl methacrylate (approximately 1:1 wt./wt.) | 1,500 ppm |
| 408 | Blend of PCI = 14.1° C. (high) and PCI = −6.9° C. (low) | Mixture of copolymer of stearyl acrylate and behenyl acrylate (1:1 wt./wt.) and the Sample 104 copolymer of behenyl methacrylate and stearyl methacrylate (approximately 1:1 wt./wt.) | 1,500 ppm/ 500 ppm |
| 410 | Blend of PCI = 14.1° C. (high) and PCI = −6.9° C. (low) | Mixture of copolymer of stearyl acrylate and behenyl acrylate (1:1 wt./wt.) and the Sample 104 copolymer of behenyl methacrylate and stearyl | 1,000 ppm/ 1,000 ppm |

TABLE 5-continued

| Sample No. | Description | Polymers | Polymer Amount in Crude Oil |
|---|---|---|---|
| | | methacrylate (approximately 1:1 wt./wt.) | |
| 412 | Blend of PCI = 14.1° C. (high) and PCI = −4.5° C. (low) | Mixture of copolymer of stearyl acrylate and behenyl acrylate (1:1 wt./wt.) and olefin maleic imide polymer | 1,500 ppm/ 750 ppm |
| 414 | Blend of PCI = 14.1° C. (high) and PCI = −4.5° C. (low) | Mixture of copolymer of stearyl acrylate and behenyl acrylate (1:1 wt./wt.) and olefin maleic imide polymer | 1,000 ppm/ 1,500 ppm |

The samples of Table 5 produced the resulting pour points and gel points listed in Table 6. Table 6

TABLE 6

| Sample No. | Pour Point (° C.) | Gel Point (° C.) |
|---|---|---|
| 400 | 36 | 33 |
| 402 | 24 | 21 |
| 404 | 24 | 21 |
| 406 | 36 | 33 |
| 408 | 21 | 18 |
| 410 | 21 | 18 |
| 412 | 21 | 18 |
| 414 | 21 | 18 |

These results further demonstrate that the combination of high-crystallization-temperature polymers and low-crystallization-temperature polymers has a synergistic effect in reducing pour points and gel points in crude oil.

Example VI

Yet another round of tests was performed to measure the performance of polymers with high and low crystallization onset temperatures, alone and in combination, as pour point inhibitors. The samples for these tests are listed in Table 7. The amount of wax deposition in these treated condensates and a percentage of wax deposition inhibition were evaluated using the Cold Finger Test, with the results depicted in Table 8.

The performance for blends of polymers with high and low crystallization onset temperatures was compared with the performance of high-crystallization-temperature polymers formulated in the absence of a low-crystallization-temperature polymer. A condensate oil from Canada was treated with 187.5 ppm of each of the samples in Table 7. As shown in Table 8, the high-crystallization-temperature polymer of Sample 502 provided negative inhibition results and an increase in wax deposition compared to the blank. Similarly, the low-crystallization-temperature polymer of Sample 504 also provided negative inhibition results. However, the blend of Sample 506 decreased the amount of deposit significantly, resulting in 60.700 inhibition of wax deposition. These results demonstrate that the synergistic combination of polymers with high and low crystallization onset temperatures may be more effective at treating condensate oils than traditional paraffin inhibitor formulations that have relied solely on high-crystallization-temperature polymers.

TABLE 7

| Sample No. | Description | Polymers |
|---|---|---|
| 500 | Blank | — |
| 502 | PCI = 8.3° C. (high) | Polymer of stearyl acrylate |
| 504 | PCI = 1.4° C. (low) | Phenolic resin polymer with average alkyl chain length between C20 and C28 |
| 506 | Blend of PCI = 8.3° C. (high), PCI = 1.4° C. (low) | Mixture of Sample 502 polymer of stearyl acrylate and Sample 504 phenolic resin polymer (approximately 1:2 wt./wt. ratio) |

TABLE 8

| Sample No. | Amount of deposit (g) | Percent Inhibition (%) |
|---|---|---|
| 500 | 0.2657 | 0 |
| 502 | 0.3246 | −22.8 |
| 504 | 0.2550 | −1.5 |
| 506 | 0.0986 | 60.7 |

In the foregoing specification, the invention has been described with reference to specific embodiments thereof. However, it will be evident that various modifications and changes can be made thereto without departing from the broader scope of the invention as set forth in the appended claims. Accordingly, the specification is to be regarded in an illustrative rather than a restrictive sense. For example, high-temperature intermediates, low-temperature intermediates, target paraffins, crystallization onset temperatures, procedures, proportions, dosages, temperatures, and amounts not specifically identified or described in this disclosure or not evaluated in a particular Example are still expected to be within the scope of this invention.

As used herein, ranges of concentration ratios should be interpreted to include any and all ratios within the prescribed ranges. For example, embodiments where the ratio of high-temperature intermediate to low-temperature intermediate is expressed within the range of 1:20 to 20:1 should be interpreted to also include the discrete intermediate concentrations ratios of 1:19, 1:18, 1:17 . . . 18:1, and 19:1 (high-temperature intermediate:low-temperature intermediate) and fractional ratios therebetween (e.g., 1:19.1 and 3.5:1). It will be understood that, as used herein, a range of X wt. % to Y wt. % will be interpreted to include the disclosure of each discrete integer value between X and Y (e.g., X, X+1, X+2 . . . Y−1, Y).

The present invention may suitably comprise, consist of, or consist essentially of the elements disclosed and may be practiced in the absence of an element not disclosed. As used herein, the singular forms "a," "an," and "the" are intended to include the plural forms as well, unless the context clearly indicates otherwise. As used herein, the term "about" in reference to a given parameter is inclusive of the stated value and has the meaning dictated by the context (e.g., it includes the degree of error associated with measurement of the given parameter). As used herein, the term "and/or" includes any and all combinations of one or more of the associated listed items.

It is claimed:

1. A synergistic paraffin inhibitor comprising:

a high-temperature intermediate with a high crystallization onset temperature between about 2° C. and 14.1° C., and a low-temperature intermediate with a low crystallization onset temperature, wherein the low crystallization onset temperature is within a range of between about 6° C. and about 30° C. lower than the high crystallization onset temperature.

2. The synergistic paraffin inhibitor of claim 1, wherein the high crystallization onset temperature is between about 2° C. and about 9.5° C.

3. The synergistic paraffin inhibitor of claim 2, wherein the high crystallization onset temperature is between about 2° C. and about 8.3° C.

4. The synergistic paraffin inhibitor of claim 1, wherein the high-temperature intermediate is selected from the group consisting of polyacrylates, polyacrylate and polymethacrylate copolymers, olefin maleic esters, olefin maleic imides and phenolic resins.

5. The synergistic paraffin inhibitor of claim 4, wherein the high-temperature intermediate comprises at least one polyacrylate having an alkyl chain of a length between C17 and C22.

6. The synergistic paraffin inhibitor of claim 1, wherein the low-temperature intermediate is selected from the group consisting of polyacrylates, polymethacrylates, polyacrylate and polymethacrylate copolymers, olefin maleic esters, olefin maleic imides and phenolic resins.

7. The synergistic paraffin inhibitor of claim 6, wherein the low-temperature intermediate comprises at least one polyacrylate having an alkyl chain of a length between C12 to C16.

8. The synergistic paraffin inhibitor of claim 1, wherein the high-temperature intermediate comprises a copolymer of stearyl acrylate and hexadecyl acrylate, and wherein the low-temperature intermediate comprises a copolymer of behenyl methacrylate and stearyl methacrylate.

9. The synergistic paraffin inhibitor of claim 1, wherein the high-temperature intermediate comprises a polymer of stearyl acrylate, and wherein the low-temperature intermediate comprises a polymer of stearyl methacrylate.

10. The synergistic paraffin inhibitor of claim 1, wherein the high-temperature intermediate comprises a polymer of behenyl acrylate and a copolymer of stearyl acrylate and behenyl acrylate, and wherein the low-temperature intermediate comprises a copolymer of behenyl methacrylate and stearyl methacrylate.

11. The synergistic paraffin inhibitor of claim 1, wherein the high-temperature intermediate comprises a copolymer of stearyl acrylate and behenyl acrylate, and wherein the low-temperature intermediate comprises a polymer of behenyl methacrylate.

12. The synergistic paraffin inhibitor of claim 1, wherein the high-temperature intermediate comprises a copolymer of stearyl acrylate and behenyl acrylate, and wherein the low-temperature intermediate comprises an olefin maleic imide polymer.

13. The synergistic paraffin inhibitor of claim 1, wherein the high-temperature intermediate comprises a polymer of stearyl acrylate, and wherein the low-temperature intermediate comprises a phenolic resin polymer comprising an alkyl chain with a length between C20 and C28.

14. The synergistic paraffin inhibitor of claim 1, wherein the high-temperature intermediate and the low-temperature intermediate are present in a range of between 1:20 and 20:1 (high-temperature intermediate:low-temperature intermediate).

15. A method of preparing a synergistic paraffin inhibitor, the method comprising the steps of:

obtaining a high-temperature intermediate with a high crystallization onset temperature between about 2° C. and 14.1° C.;

obtaining a low-temperature intermediate with a low crystallization onset temperature, wherein the low crystallization onset temperature is between about 6° C. and about 30° C. lower than the high crystallization onset temperature; and mixing the high-temperature intermediate and the low-temperature intermediate.

16. The method of claim 15, further comprising the step of identifying the high-temperature intermediate as suitable to treat a specific oil selected from synthetic oils, crude oils, and heavy crude oils.

17. The method of claim 16, wherein the step of identifying the high-temperature intermediate as suitable to treat the specific oil further comprises the step of evaluating the paraffin and/or wax composition of the specific oil.

18. A method of treating a crude oil with a synergistic paraffin inhibitor, the method comprising the steps of:

preparing the synergistic paraffin inhibitor, further comprising the steps of:

obtaining a high-temperature intermediate with a high crystallization onset temperature between about 2° C. and 14.1° C.;

obtaining a low-temperature intermediate with a low crystallization onset temperature, wherein the low crystallization onset temperature is within a range of between about 6° C. and about 30° C. lower than the high crystallization onset temperature; and mixing the high-temperature intermediate and the low-temperature intermediate; and introducing the synergistic paraffin inhibitor to the crude oil.

19. The method of claim 18, wherein the high-temperature intermediate is selected from the group consisting of polyacrylates, polyacrylate and polymethacrylate copolymers, olefin maleic esters, olefin maleic imides and phenolic resins, and the low-temperature intermediate is selected from the group consisting of polyacrylates, polymethacrylates, polyacrylate and polymethacrylate copolymers, olefin maleic esters, olefin maleic imides and phenolic resins.

20. The method of claim 18, wherein the high-temperature intermediate comprises a polymer of stearyl acrylate, and wherein the low-temperature intermediate comprises a phenolic resin polymer comprising an alkyl chain with a length between C20 and C28.

* * * * *